US008196927B2

(12) United States Patent
Marantz et al.

(10) Patent No.: US 8,196,927 B2
(45) Date of Patent: Jun. 12, 2012

(54) GAMBLING GAME

(76) Inventors: Michael Marantz, Diamond Bar, CA (US); Gordon Marantz, Diamond Bar, CA (US)

( * ) Notice: Subject to any disclaimer, the term of this patent is extended or adjusted under 35 U.S.C. 154(b) by 147 days.

(21) Appl. No.: 12/877,013

(22) Filed: Sep. 7, 2010

(65) Prior Publication Data

US 2012/0056371 A1 Mar. 8, 2012

(51) Int. Cl.
*A63F 7/28* (2006.01)
*A63F 5/02* (2006.01)

(52) U.S. Cl. ..... 273/138.4; 273/138.3; 273/144 A; 273/144 R; 273/142 E; 273/145 B

(58) Field of Classification Search ..... 273/138.3, 273/138.4, 138.5, 144 R, 142 E, 142 F, 142 G, 273/145 R, 144 B, 145 B
See application file for complete search history.

(56) References Cited

U.S. PATENT DOCUMENTS 2,607,592 A * 8/1952 Finnerty ..... 273/110
3,610,628 A * 10/1971 Promin ..... 273/138.4
3,645,530 A * 2/1972 Hernandez et al. ..... 273/138.4
3,895,808 A * 7/1975 Averette ..... 273/138.4
4,147,352 A * 4/1979 Rosero ..... 273/138.4
5,102,135 A 4/1992 Addeichi
5,228,698 A 7/1993 Dubarry, Jr.
5,848,936 A 12/1998 Morrison
6,302,395 B1 10/2001 Astaneha
6,520,503 B1 2/2003 Porto
6,688,597 B2 * 2/2004 Jones ..... 273/274
6,761,353 B2 7/2004 Berman et al.
6,769,688 B1 8/2004 Lean
7,478,812 B2 1/2009 Sokolov
7,527,265 B1 5/2009 Berman
7,549,637 B2 6/2009 Lease
2009/0230624 A1 9/2009 Aguilera

* cited by examiner

*Primary Examiner* — Benjamin Layno

(57) ABSTRACT

A game, similar to craps, is described, where two marbles may be thrown by the players into a spinning machine. The spinning machine may include a funnel at the top of the machine into which the players may throw the marbles, a cylinder through which the marbles may pass, and a spinner to spin 12 slots that may receive the marbles from the cylinder. Two marbles may be thrown into the funnel and may exit into a first set of six slots, which may be numbered from 1-6 (or A, 2, 3, 4, 5 and 6) of one suit (such as hearts), and a second set of six slots, similarly numbered, or a different suit (such as spades). The two slots into which the marbles fall may equate to two dice being rolled in certain traditional craps games. A table may be designed specifically for the game, wherein up to eight players may play at the same time.

8 Claims, 3 Drawing Sheets

GAMBLING GAME

BACKGROUND OF THE INVENTION

The present invention relates to games and, more particularly, to a gambling game similar to a traditional craps game using two marbles and a manual machine to establish a point number or a winning number and a special gambling table layout to be used with the machine.

In Nevada casinos, for example, casinos use dice in the game of craps. The players roll the dice themselves to establish the point and winning numbers. In Indian casinos, cards are typically used by the dealers and the players do not participate in establishing the point or the winning number. Such games may be less exciting for the players, as direct involvement in the game is not required.

As can be seen, there is a need for a gambling game, similar to craps, where the players may be involved physically in the game.

SUMMARY OF THE INVENTION

In one aspect of the present invention, a spinning machine comprises a funnel adapted to receive at least one marker device; a cylinder adapted to reposition the marker device as it passes through the cylinder; a plurality of tubular slots adapted to receive the at least one marker device, wherein each tubular slot has a value assigned thereto.

In another aspect of the present invention, a game comprises a game table designed for a plurality of players to sit around; and a spinning machine comprising a funnel adapted to receive two marbles; a cylinder adapted to reposition the marbles as they passes through the cylinder; and a plurality of tubular slots adapted to receive the marbles, wherein each tubular slot has a value assigned thereto, wherein the spinning machine is adapted to be moved close to each player, thereby allowing the player to throw the marbles into the funnel of the spinning machine, and wherein the value of each of the marbles is added and used as the players throw for playing the game.

These and other features, aspects and advantages of the present invention will become better understood with reference to the following drawings, description and claims.

DETAILED DESCRIPTION OF THE INVENTION

Figure 1:
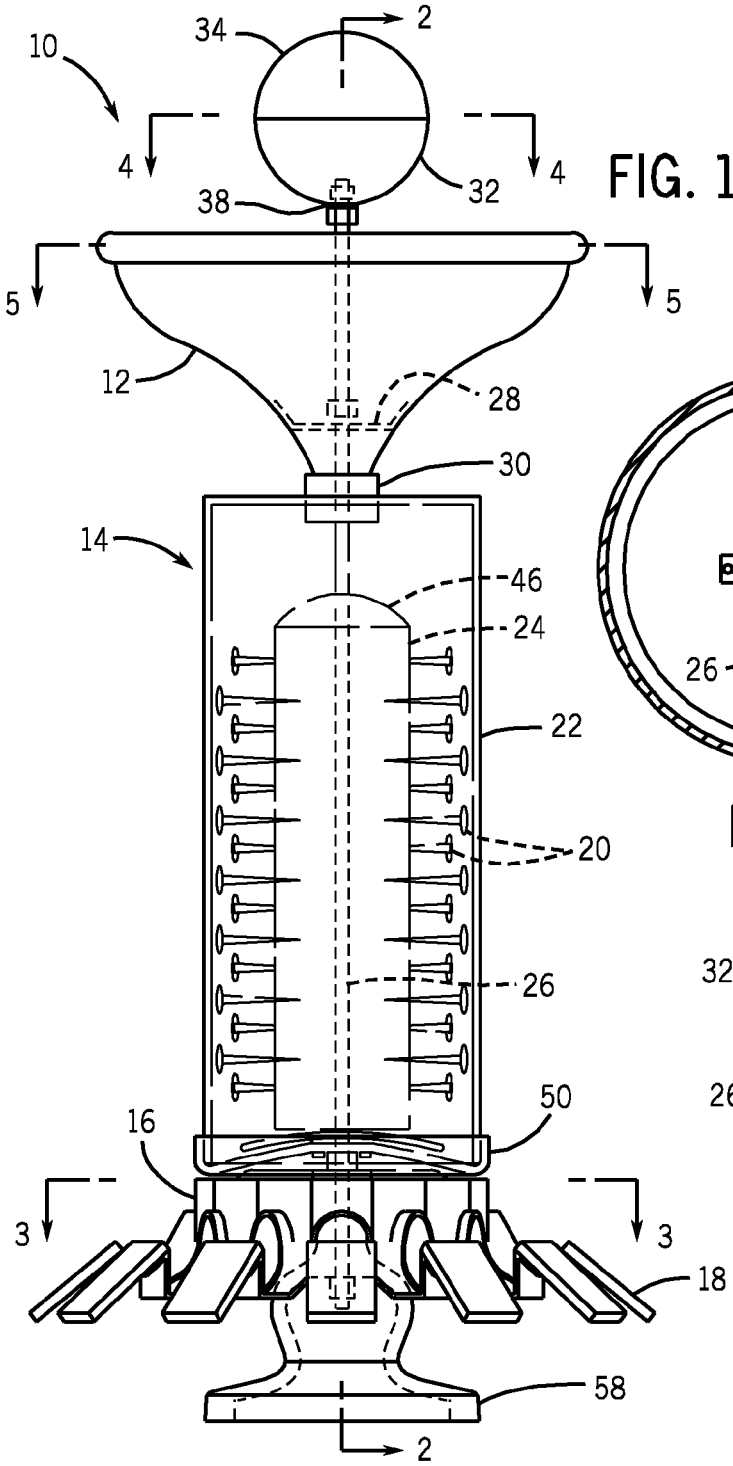
FIG. 1 is a perspective view of a gaming machine according to an embodiment of the present invention.
Figure 5:
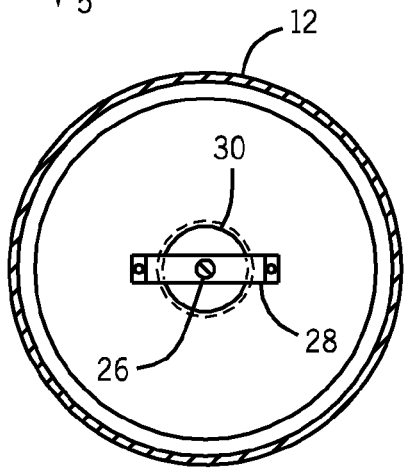
FIG. 5 is a cross-sectional view of the gaming machine taken along line 5-5 of FIG. 1.
Figure 4:
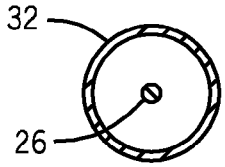
FIG. 4 is a cross-sectional view of the gaming machine taken along line 4-4 of FIG. 1.
Figure 2:
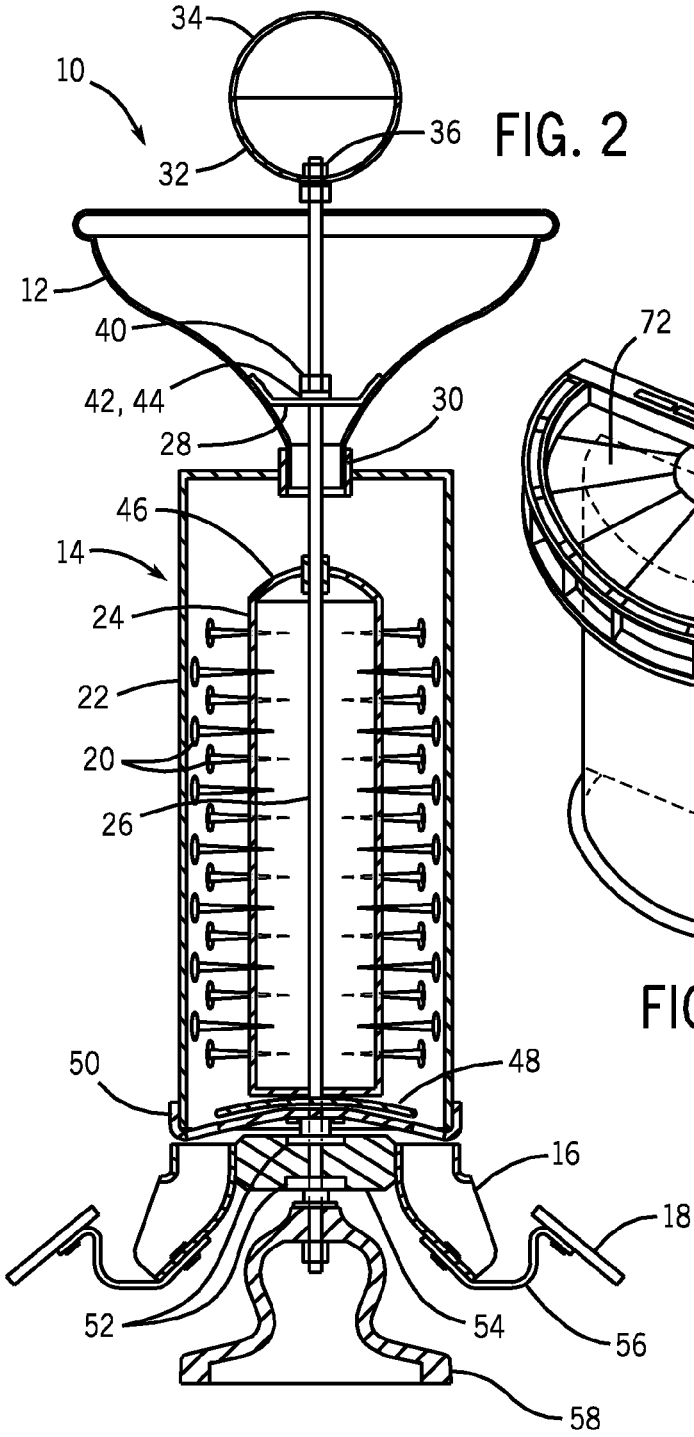
FIG. 2 is a cross-sectional view of the gaming machine taken along line 2-2 of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a game, similar to craps, where two marking devices, such as marbles, may be thrown by the players into a spinning machine. The spinning machine may include a funnel at the top of the machine into which the players may throw the marbles, a cylinder through which the marbles may pass, and a spinner to spin 12 slots that may receive the marbles from the cylinder. Two marbles may be thrown into the funnel and may exit into a first set of six slots, which may be numbered from 1-6 (or A, 2, 3, 4, 5 and 6) of one suit (such as hearts), and a second set of six slots, similarly numbered, or a different suit (such as spades). The two slots into which the marbles fall may equate to two dice being rolled in certain traditional craps games. The present invention further includes a table designed specifically for the game, wherein up to eight players may play at the same time.

Referring to FIGS. 1 through 5, a spinning machine 10 for a game, such as craps, may include a funnel 12 at the top of the machine 10 into which the players may throw marbles (not shown). Typically, two marbles may be thrown into the machine 10 for a single throw. The marbles may pass through the funnel 12 and into a cylinder 14. After passing through the cylinder 14, the marbles may exit through 1 of 12 tubular slots 16 to arrive at a number 18 for that marble. The tubular slots 16 may be adapted to spin relative to the cylinder 14, providing additional randomness for the final destination of each marble. For example, one marble may exit the tubular slot 16 to arrive at the number 1, and a second marble may exit the tubular slot to arrive at the number 4, resulting in a throw of five. This may be used, for example, to establish the point number or a subsequent throw, as is typically done in the game of craps.

The cylinder 14 may include a central cylinder 24 having a plurality of studs 20 attached thereto. The studs may be made of, for example, wood, metal, or plastic. The cylinder 14 may further include a cylindrical enclosure 22 to keep the marbles received from the funnel 12 between the central cylinder 24 and the cylindrical enclosure 22. In one embodiment, the cylindrical enclosure 22 may be clear, thereby allowing the players to see the marbles as they fall over the studs 20 and into the tubular slots 16, adding excitement to the game during play.

The funnel 12 and the central cylinder 24 may be mounted on a central shaft 26, such as a threaded rod. A shaft retainer bracket 28 may connect the shaft 26 to the funnel 12. Nuts 40, flat washers 42 and lock washers 44 may be used, for example, to secure the shaft retainer bracket 28 to the funnel 12. Other means, as may be known in the art, may secure the funnel to the central shaft 26. Threaded connections 30, as may be known in the art, may be used to connect the funnel to the cylinder 14.

A main handle 32 may be attached at the top end of the central shaft 26. Typically, the main handle 32 may extend above the funnel 12, providing means for moving the spinning machine 10. In alternate embodiments, the main handle 32 may be disposed inside the funnel 12. The main handle 32 may be hollow, with a removable cover 34. Extra marbles, for example, may be stored within the main handle 32. A round head nut 36 and lock washers 38, or other means known in the art, may be used to secure the main handle 32 onto the central shaft 26.

One or more bells may be disposed inside of the cylinder 14. One bell 46 may be disposed near the top of the cylindrical enclosure 22. This bell 46 may ring when the marbles exit the funnel and enter the cylinder 14. A second bell 48 may be disposed at the bottom of the cylindrical enclosure 22. This bell 48 may ring just before the marbles exit the cylinder 14 and enter the tubular slots 16.

The cylinder 14 may be mounted on a support member 50. Below the support member 50, the tubular slots 16 may be mounted to a housing 54 of a bearing 52. The bearing 52 may be attached to the central shaft 26 by methods known in the art, such as with nuts, flat washers and/or lock washers. The bearing 52 may permit the tubular slots 16 to rotate about the central shaft 26.

The main shaft 26 may terminate in a main support 58. The main support 58 may be made of a heavy material to prevent the machine 10 from toppling.

Figure 3:
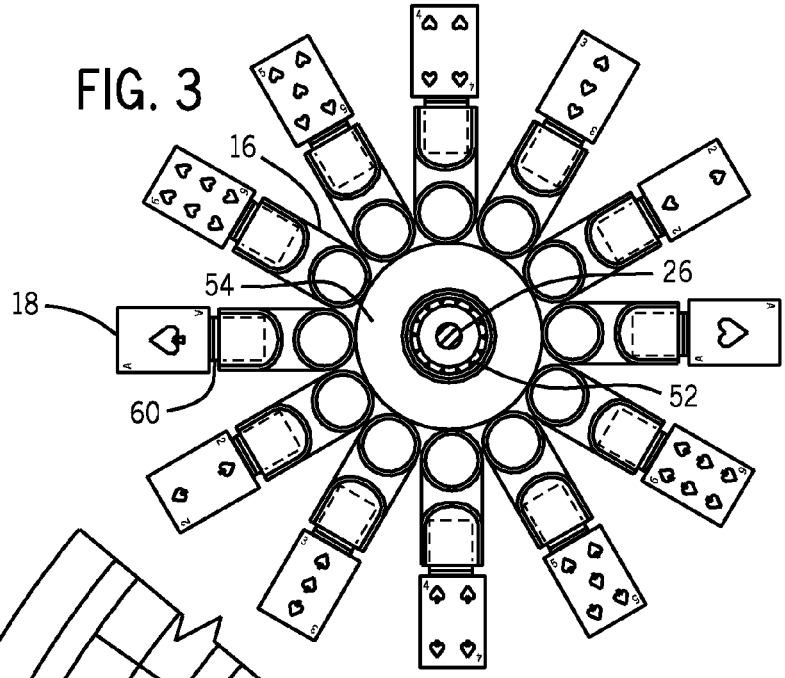
FIG. 3 is a cross-sectional view of the gaming machine taken along line 3-3 of FIG. 1.

Referring specifically to FIG. 3, the tubular slots 16 may be attached to the bearing housing 54 to permit rotation of the tubular slots 16. The point numbers 18 may, for example, attach to the tubular slots 16 with a bracket 60. In one embodiment, the point numbers 18 may be identified by cards attached to the brackets 60 on each tubular slot 16. In an alternate embodiment, the point numbers 18 may be dice (not shown) positioned on each tubular slot 16. In an alternate embodiment, the point numbers 18 may be inscribed on the tubular slot 16. In a further alternate embodiment, the point numbers 18 may be lights (not shown) on the tubular slots 16. The lights may illuminate when the marble falls into that particular tubular slot 16. Typically, 12 tubular slots 16 are disposed on the bearing housing 54. Typically, the 12 slots are labeled with two each of numbers 1 through 6.

Figure 7:
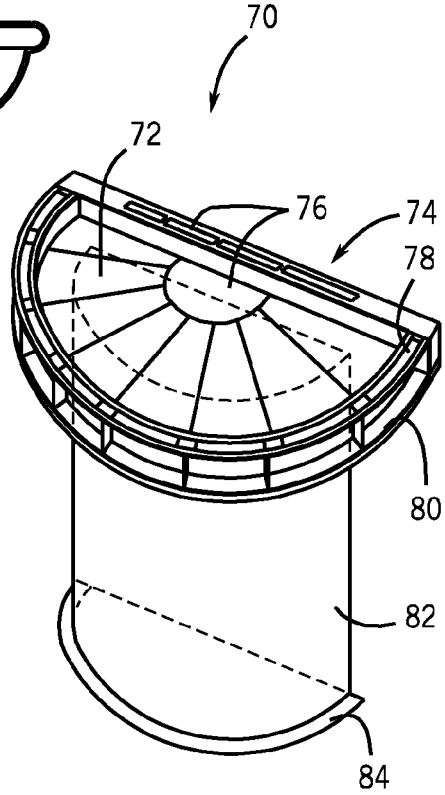
FIG. 7 is a perspective view of the gaming table shown in FIG. 6.
Figure 6:
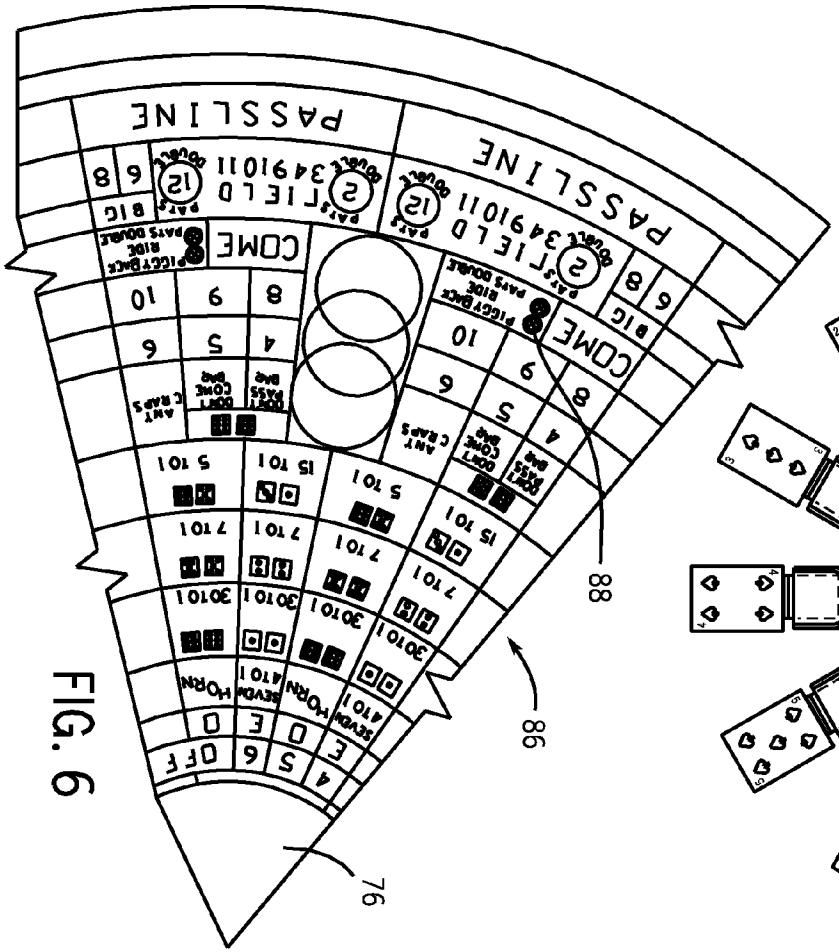
FIG. 6 is a top view of a portion of gaming table according to an embodiment of the present invention.

Referring now to FIGS. 6 and 7, a game table 70 may include a semi-circular top portion 72 adapted for players to sit around its circumference. A dealer may be positioned on a straight edge 74 of the table 70. The table 70 may include spaces 76 for the dealer to place chips for the casino's use. The table 70 may further include, about its circumference, slots 78 for each player to place their chips. Typically, there may be room for up to eight players around the table 70. The table 70 may be designed with an optional beverage compartment 80 located about the circumference of the table 70. A pedestal support 82 may hold the top portion 72 of the table 70. A base 84 may be disposed below the pedestal support 82.

Each players playing space 86 is shown in detail in FIG. 6. The playing space 86 may include places to place various bets, similar to a typical craps table. An additional bet, called a piggyback ride 88, may be present in the playing space 86. The piggy back ride 88 may be achieved when the two marbles land on the same tubular slot. The payout for winning this bet may be determined by the casino.

A spinning machine space 90 may be provided for positioning the spinning machine 10 on the table 70. There may be, for example, four spinning machine spaces 90 spaced apart on the top portion 72 of the table 70. This may permit the spinning machine 10 to be located near each player during play of the game.

In an alternate embodiment, the table 70 may be designed, instead of, or in addition to the spinning machine spaces 90, with a slide (not shown) that may move the machine 10 from one end of the table to the other end of the table.

The game may be played similar to how craps is played with dice. One player may have a turn throwing the marbles. The first numbers the marbles land on are added to give the point number (unless a 2, 3, 7, 11 or 12 is thrown, for example). The same player may continue to throw the marbles until their turn is over, typically once a seven is thrown. The rules may be similar to craps, unless both marbles fall into the same tubular slot. This may result in players winning the piggy back ride bet. The casino may establish rules for playing and paying out the piggy back ride bet.

As shown in FIG. 3, the point numbers may be determined by a first set of cards (A, 2, 3, 4, 5 and 6) of a red suit (such as hearts) and a second set of cards (A, 2, 3, 4, 5 and 6) of a black suit (such as spades). This design may allow alternate betting options, such as two hearts, two spades, and the like.

The spinning machine 10, described above, may be used on the table 70 or may be used on a separate table or, alternatively, on a table topper (not shown) placed on a conventional table. The spinning machine 10 may also be used on a traditional craps table. The spinning machine 10 may be portable, thereby allowing use either in a casino or for entertainment at home.

While the above description focuses on using the spinning machine 10 for playing a gambling game, the spinning machine 10 may have other uses where random generation of numbers, colors or other objects is desired. For example, the spinning machine 10 may be used as a grade school math game, where marbles are thrown and the students need to add or multiply, for example, the numbers indicated by the output of the machine. In other embodiments, instead of numbers as the point numbers, colors or shapes could be placed. A player may then have to identify the color or shape that the marbles fall out on.

It should be understood, of course, that the foregoing relates to exemplary embodiments of the invention and that modifications may be made without departing from the spirit and scope of the invention as set forth in the following claims.

What is claimed is:

1. A spinning game machine comprising:

a funnel at the top of the machine, the funnel adapted to receive at least one marker device and adapted to have the marker device pass through the funnel;

a cylinder mounted below the funnel, the cylinder adapted to reposition the marker device as it passes through the funnel and the cylinder;

a plurality of tubular slots mounted below the cylinder, the plurality of tubular slots adapted to receive the at least one marker device, wherein each tubular slot has a value assigned thereto;

a handle on the spinning machine; and a removable top on the handle, wherein the handle is hollow and provides a space for storage of marker devices.

2. The spinning machine of claim 1, further comprising a bearing adapted to permit rotation of the tubular slots relative to the cylinder.

3. The spinning machine of claim 1, wherein the at least one marker device comprises two marbles.

4. The spinning machine of claim 1, further comprising studs within the cylinder, the studs repositioning the marking device as it passes through the cylinder.

5. The spinning machine of claim 1, further comprising:

a central shaft attached to the funnel; and a main support adapted to support the central shaft, wherein the central shaft supports the cylinder thereupon.

6. The spinning machine of claim 1, wherein the plurality of tubular slots includes 12 tubular slots, with a first set of tubular slots numbered from 1 to 6 and a second set of tubular slots numbered from 1 to 6.

7. A game comprising:

a game table designed for a plurality of players to sit around;

a spinning game machine comprising:

a funnel at the top of the machine, the funnel adapted to receive two marbles and adapted to have the two marbles pass through the funnel;

a cylinder mounted below the funnel, the cylinder adapted to reposition the marbles as they pass through the funnel and the cylinder;

a plurality of tubular slots mounted below the cylinder, the plurality of tubular slots adapted to receive the marbles, wherein each tubular slot has a value assigned thereto, wherein the spinning machine is adapted to be moved close to each player, thereby allowing the player to throw the marbles into the funnel of the spinning game machine, and wherein the value of each of the marbles is added and used as the players throw for playing the game;

a piggy back ride betting space on the game table, wherein the piggy back ride betting space wins when both marbles fall into the same one of the plurality of tubular slots.

8. The game of claim 7, wherein the game is played according to the rules of craps.

* * * * *